United States Patent [19]

Williams, Jr.

[11] 4,241,295

[45] Dec. 23, 1980

[54] DIGITAL LIGHTING CONTROL SYSTEM

[76] Inventor: Walter E. Williams, Jr., 21 Woodland St., New Haven, Conn. 06511

[21] Appl. No.: 13,080

[22] Filed: Feb. 21, 1979

[51] Int. Cl.[3] ..... H05B 39/08

[52] U.S. Cl. ..... 315/294; 315/199; 315/291

[58] Field of Search ..... 315/194, 199, 291–294, 315/312, 314, 316

[56] References Cited

U.S. PATENT DOCUMENTS

| | | | |
|---|---|---|---|
| 3,784,874 | 1/1974 | Barrett et al. | 315/293 X |
| 4,087,702 | 5/1978 | Kirby et al. | 315/194 X |
| 4,095,139 | 6/1978 | Symonds et al. | 315/294 X |

FOREIGN PATENT DOCUMENTS

| | | | |
|---|---|---|---|
| 2133844 | 1/1972 | Fed. Rep. of Germany | 315/292 |

*Primary Examiner*—Eugene R. LaRoche

[57] ABSTRACT

A lighting control system for the control of the intensity of a plurality of lights, such as in theatre and television lighting, operating entirely by digital means. A novel trigger pulse generating means provides a trigger pulse for each SCR-type dimmer the phase angle of which pulse is a function of a binary encoded intensity indicating signal. The transfer characteristic of the system is controlled by a time-base generator providing and accumulating a phase encoded pulse train using information stored in a memory. The entire process is accomplished by binary means. The system provides more reliable, dependable and accurate lighting control at less cost, with especial reference to the marginal dimmer cost, than systems heretofore available.

10 Claims, 6 Drawing Figures

DATA TERMINAL
11
17
10
COMPUTER
14
CLOCK
15
EOHC GENERATOR
13
DMA
18
19
20
21
22
12
TRIGGER PULSE GENERATOR
23
24
25
26
27
28
29
30
31
32
33
+5V
39
16
40
37
AC LINE
+15 V
35
34
36
38
41
42

19
A
B
C
D
E
F
G
H
I
J
K
L
M
N
O
P
52
COUNTER
56
57
55
23
54
24
J K
20
53
51
22
21
58
59
25A
25B
25C
50

DIGITAL LIGHTING CONTROL SYSTEM

BACKGROUND OF THE INVENTION

The invention relates to lighting control systems, and more particularly to electronic control apparatus for controlling the intensity of a plurality of electric lamps of the type used for illumination in theatres, television studios and the like.

Lighting systems are known wherein the intensity of a lamp is controlled by a thyristor in series with the AC line and the lamp load. The firing angle of the thyristor controls the power to the lamp and hence the intensity of the lamp in response to a small analog DC control voltage signal. Systems are also known wherein the said DC control signal is derived from a binary encoded signal by a digital to analog converter means. Such systems require the use of a digital to analog converter and an analog control circuit for each channel to be controlled in order to provide a phase encoded trigger pulse in response to the binary control signal. The analog components required in circuits of this type are expensive, subject to variation with respect to time and variation from component to component and are also subject to relatively frequent failure. In addition circuits of this type require frequent adjustment in order to maintain accurate and uniform transfer characteristics from dimmer to dimmer. A further disadvantage of prior art systems is that because of the expense of each dimmer and the number of lighting circuits to be controlled a relatively small number of dimmers are provided and a "patch panel" is additionally provided to connect these dimmers to the several circuits.

It is a general object of the present invention to provide a lighting control system which is more accurate and reliable than systems heretofore available.

Another object of the present invention is to provide a lighting control system wherein the marginal cost of dimmers in the system is less than that of such systems heretofore available.

Another object of the present invention is to provide a lighting control system wherein the transfer characteristic may be easily and accurately changed yet will not require frequent adjustment.

Briefly, these and other objects of the invention are achieved by a system comprised entirely of digital means. A binary encoded signal indicating the desired intensity for each control channel as a number of intensity increments is provided by a digital computer or similar digital signal generator. A trigger pulse generator means produces one trigger pulse for each channel, the phase angle of said pulse being a function of the binary encoded intensity indicating signal. The transfer characteristic is controlled by a time-base generator which sequentially counts out binary values stored in a memory to generate a phase encoded pulse train which effectively divides each half-cycle into a number of timed increments corresponding to the intensity increments defined by the intensity indicating signal. The intensity indicating signal and the time-base signal are combined in the trigger pulse generator to produce a trigger pulse which, when applied to the gate of a thyristor, controls the intensity of a lamp connected in series with said thyristor. The invention also includes a novel method for compensating for changes in line voltage by providing a voltage controlled clock frequency to the time-base generator.

BRIEF DESCRIPTION OF THE DRAWINGS

Other objects, features and advantages of the invention will become apparent, and its construction and operation better understood, from the following detailed description taken in conjunction with the accompanying drawings in which.

DESCRIPTION OF THE PREFERRED EMBODIMENT

Most lighting systems in this country operate from a standard four or five wire 60 Hz three phase 120 Volt AC supply line. The preferred embodiment of the present invention will be considered to operate from such a supply; however, this description will illustrate the operation of only one phase where such operation is duplicated for each phase. Therefore the phrase "AC line", for example, will be understood to mean the one phase of the AC supply line appertaining to the specific circuit under discussion, also the phrase "half-cycle" will be understood to refer to the excursion of the AC line voltage from one zero crossing to the next (about 8.3 ms.) for the phase of the AC supply line appertaining to the specific circuit under discussion unless otherwise indicated.

It will further be understood in the following description that power supply connections and the like exist though they are not explicitly indicated and that high and low levels refer to digital logic levels in accordance with standard practice in the art.

Figure 1:
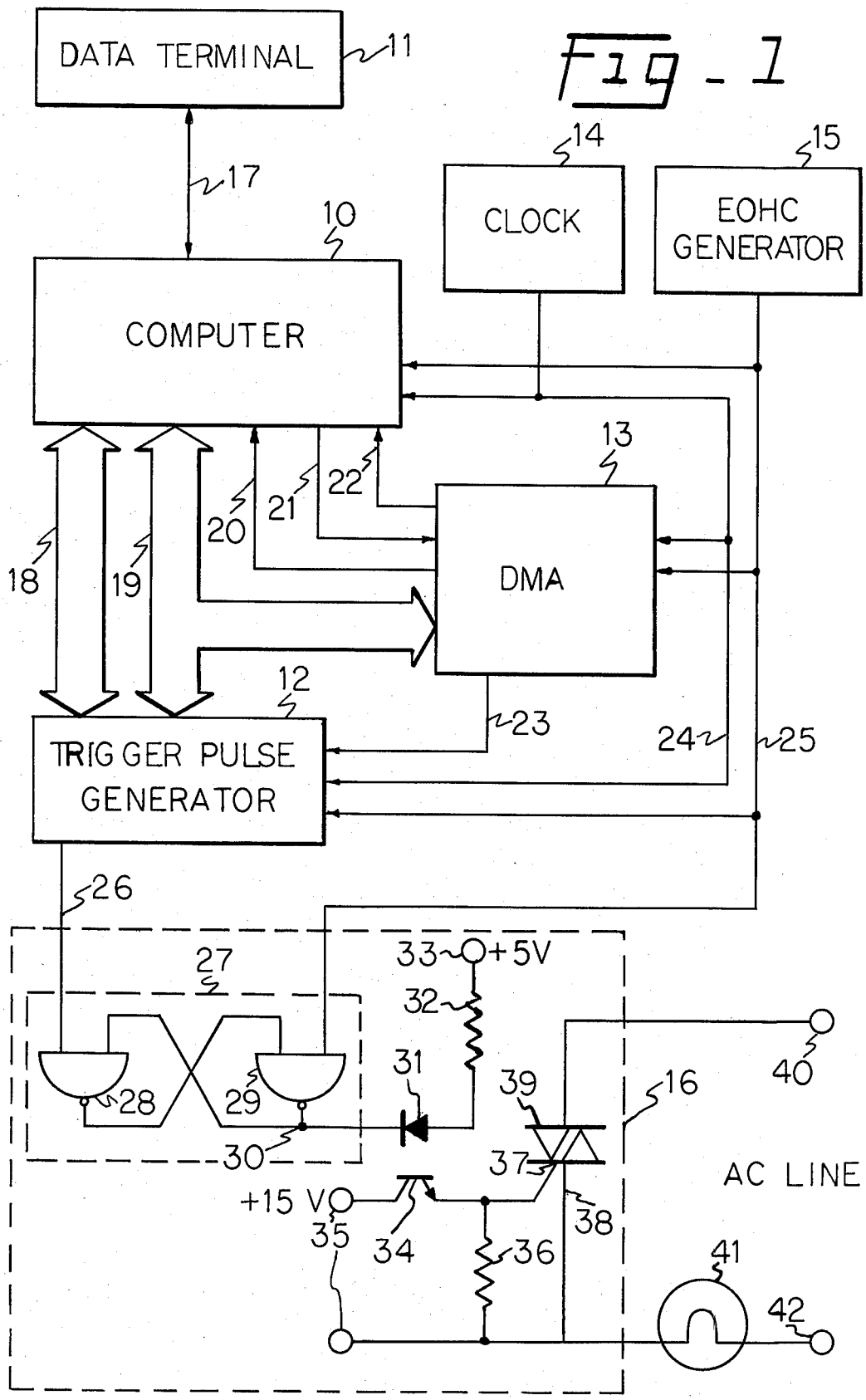
FIG. 1 is a block diagram illustrating the preferred embodiment of the system.

Referring now to FIG. 1, it will be seen that the preferred embodiment of the system is comprised of seven sections, these are: a digital microcomputer 10, data terminal 11, a trigger pulse generator means 12, a means for generating an EOHC (end-of-half-cycle) signal 15, a system clock 14, a DMA (direct memory access) means 13, and a thyristor section 16.

The operation and apparatus of the EOHC generator means 15 and the trigger pulse generator means 12 are duplicated for each phase. The preferred three phase embodiment thus minimally requires one each of the microcomputer 10, data terminal 11, system clock 14, and DMA 13, and three each of the trigger pulse generator means 12, and EOHC signal generator 15 being one of each for each of three phases. One thyristor section 16 is required for each channel to be controlled.

Referring now, more specifically, to the computer section 10 in FIG. 1. The computer 10 is a standard micro-computer such as, for example, the Z-2 as manufactured by Cromemco Inc. of Mountain View, Cal. and is comprised of a central processor unit, read only memory (ROM), data terminal interface, and random access memory (RAM). In practice the computer 10 also contains the system clock 14 which generates a single phase 4 MHz square wave signal, this signal is used for synchronous timing of the several elements of the system including the computer 10, DMA 13, and trigger pulse generator 12.

Functionally the computer section 10 serves as a means for producing a binary coded signal for each channel indicating the desired intensity for said channel. In the preferred embodiment there are 200 possible levels of intensity and these are indicated in binary form by an 8 bit signal having a value from 11111110, indicating full intensity, through 00111000, indicating zero intensity. The computer 10 generates one such signal for each channel in the system and stores said signals in an operational memory (not shown) which memory may be a portion of the computer 10 random access memory reserved for storage of said signals. Each such signal is stored in a separate memory address location, thus there will be as many address locations holding intensity indicating signals as there are channels in the system, further, in the preferred embodiment said memory address locations are arranged sequentially, either consecutively or by some power of 2, to facilitate their access by the Direct Memory Access means 13.

It will be clear to those practiced in the art that a high speed digital computer or microcomputer 10 will be capable of modifying the intensity indicating signal for each channel at regular intervals so as to execute movements from one intensity value to another such that they will appear to be continuous fades in lighting intensity. In order to accomplish these fades smoothly however it is necessary that the intensity indicating signals be communicated to the trigger generating means 12 at regular time intervals. It is further necessary that said signals be delivered at a time when the trigger generator is otherwise inactive; that is, at the end of each half cycle.

Said communication is accomplished at the end of each half-cycle of each phase for some or all the channels appertaining to that particular phase by a direct memory access (DMA) means 13. The DMA sequentially addresses each intensity indicating location in the computer's operational memory by placing a binary encoded address signal on the address bus 19, reading the value stored at that location onto the computer data bus 18, then delivering a write enable signal to the trigger pulse generator which in turn records the intensity indicating value from the data bus. The DMA process takes only a few hundred micro seconds, thus a single embodiment of the DMA 13 means can transfer data for all three phases.

Figure 2:
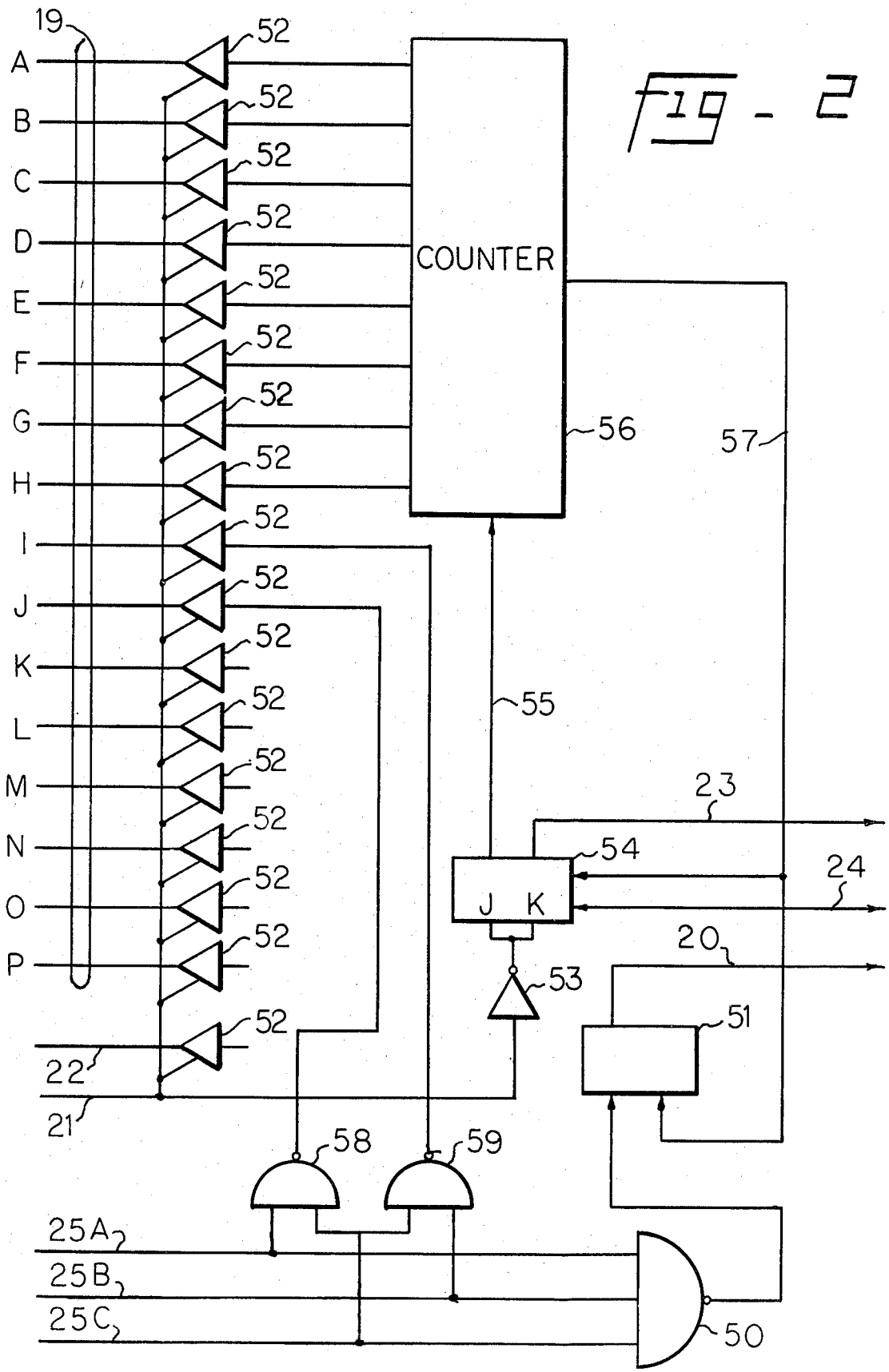
FIG. 2 is a diagram of a Direct Memory Access (DMA) means.

The DMA 13 is shown in detail in FIG. 2.

At the end of a half-cycle for any of the three phases one of the EOCH lines 25; a, b, c goes low thus driving the output of the NOR gate 50 high, this in turn sets the bus request flip-flop 51 and activates the bus request line (BRQ) 20 which communicates directly with the computer CPU 10. The computer responds by placing all data bus 18 and address bus 19 lines and certain control lines 22 in a high impedance state and bringing the bus acknowledge line (BAK) 21 low. The bus acknowledge line 21 communicates with the DMA 13 and drives the normally high impedance output of the buffers 52 to a low impedance state and thus allows the DMA 13 to place information on the address bus 19, and certain control lines 22. The BAK signal is also inverted 53 and brings the J and K inputs of the JK flip-flop 54 high thus allowing the output of the JK flip-flop 54 to alternate levels with each clock pulse received from the clock line 24. One of the said outputs 55 is connected to the counting input of the address counter 56 and the other output of the JK flip-flop 54 is connected to a write line 23 which connects with the trigger generator or generators 12. This results in a write pulse being delivered to the trigger pulse generating means 12 for each increment of the address counter 56 as the counter 56 is counted up from zero to a full count. This action also prevents errors resulting from a write pulse being delivered at the time that the address counter 56 is incremented. When the address counter 56 has counted through its complete iteration it generates an overflow signal onto overflow line 57 which overflow signal resets the bus request flip-flop 51 and thus returns control of the data bus 18, address bus 19 and certain control 22 lines to the computer CPU 10. The overflow signal also resets the JK flip-flop 54 and clears the counter 56 to zero.

In the preferred embodiment the address counter controls only 8 lines of the 16 line address bus, 19 A to 19 H. The logic levels of the remaining address lines are determined as follows: the two address lines immediately more significant than the most significant line of the counter, 19 I and 19 J, are connected to the output of the two NAND gates 58 and 59 such that these address lines hold a value which depends on which of the three EOHC 25 *a, b, c,* lines is low, hence addressing a different block of memory for each phase. This is accomplished by connecting one of the EOHC lines 25*c* to one input of each of the NOR gates 58, 59, connecting one of the remaining EOHC lines 25*a,* to the remaining input of one of the NAND gates 58, and connecting the remaining EOHC line 25*b,* to the remaining input of the remaining NAND gate 59. The remaining address lines 19*k* to 19*p* are clamped either high or low such that the DMA addresses only those memory locations containing intensity indicating signals. In addition the appropriate control line 22 for a memory read operation are clamped to the appropriate level and enabled by a buffer 53 along with the Address Buffers 52.

It will be clear that some means must be provided whereby each intensity indicating signal read out of the operational memory 10 by the action of the DMA 13 will be will be recorded only by the trigger pulse generator channel to which said intensity indicating signal appertains. This is accomplished by providing a unique location in a trigger pulse generator memory means 71 for each channel and an address decoder 70 for each trigger generator means 12 which enables the memory 71 to record the intensity indicating value at said unique memory address location for each lighting channel. It is convenient to chose each such address value in the trigger generator memory means 71 such that it corresponds to the address value in the operational memory of the intensity indicating signal location appertaining to said channel. This method allows the DMA address counter 56 to simultaneously address both the address location in the operational memory of the computer 10 and the address location in the trigger pulse generator 12, and provides a fast and economical means of transferring data. Data will, of course, be recorded by the trigger pulse generator memory means 71 only in response to a write signal from the DMA 13.

Figure 3:
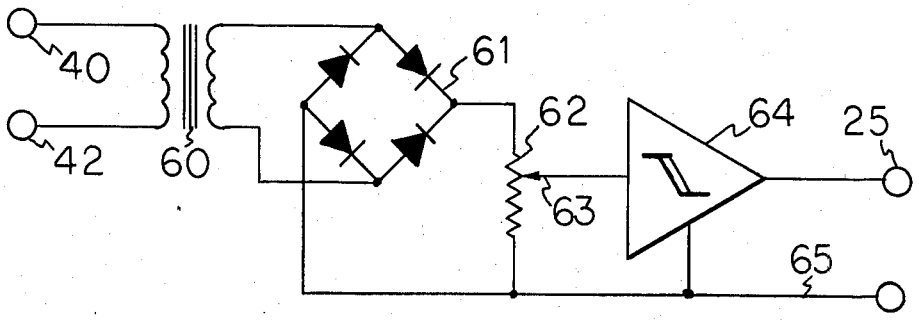
FIG. 3 is a schematic diagram of an End of Half-cycle signal generator means.
Figure 5:
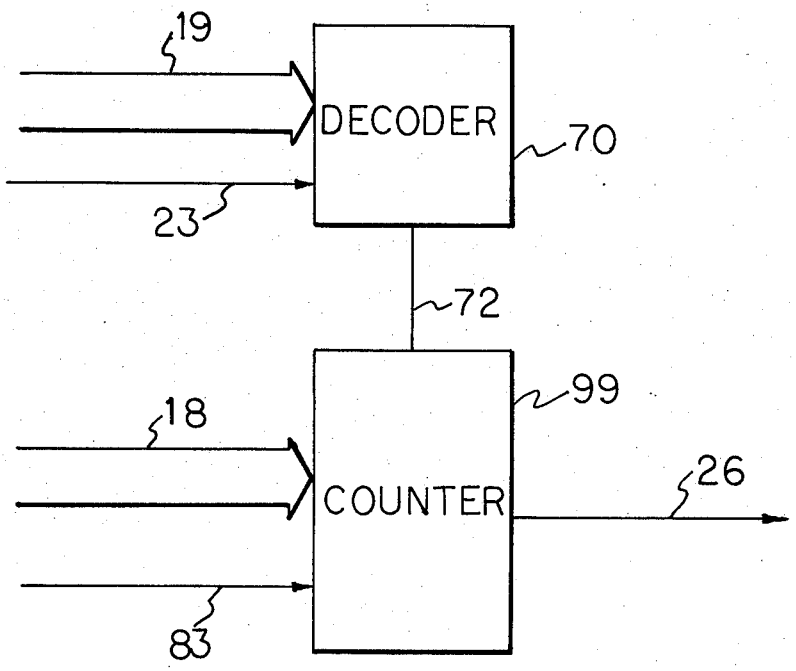
FIG. 5 is a diagram illustrating essential elements of another embodiment of the trigger generator means.

It has been noted that the DMA 13, as well as other elements of the system, receives an EOHC signal from each phase, the means by which this signal is provided is the EOHC signal generator 15. Referring now to FIG. 3, which illustrates a simple embodiment of the EOHC generator 15. In operation one phase of the 120 VAC line is applied to the primary winding of the isolation transformer 60 thus inducing a similar voltage in the secondary winding of said transformer. This voltage is applied to the AC input terminals of a full wave bridge rectifier 61, the full wave rectified output of the bridge rectifier is applied to the end point terminals of a potentiometer 62 with the negative terminal also connected to the system negative common return, 65, such that a full wave signal of adjustable amplitude will appear between the negative common return 65 and the slider 63 on the potentiometer 62. Said signal is applied to the input terminal of a schmitt trigger 64, the output voltage of which, of course, drops to zero for a time at the end of each half-cycle and remains at a high voltage level during the remainder of the cycle thus providing the required EOHC signal on the EOHC line 25. One such circuit is required for each phase of the AC line.

It is well known in the art of stage lighting that the ideal transfer characteristic for lighting control systems is not a linear characteristic. This is due to the fact that the lamps used for such lighting do not have a linear voltage/light output characteristic, and the fact that the human eye has a non-linear perception of lighting levels. Several lighting curves are currently in use, among these are the so-called "square law" and "linear light" curves. A more complete discussion of these curves may be had by reference to U.S. Pat. Nos. 4,098,414; 3,588,598; or other prior art.

Prior art has used a trigger pulse generating means wherein the transfer characteristic is determined by a nonlinear analog voltage ramp, (see, for example, *GE SCR Manual;* General Electric Company; Syracuse, N.Y.; Fourth Edition; 1967; pp. 191–196). The present invention eliminates several disadvantages inherent in the prior art method by employing a trigger generating means 12 comprised entirely of digital means. There will follow descriptions of two embodiments of the present invention, both of which use the same embodiment of a time base generator 73 and differ in the embodiment of the remainder of the trigger pulse generator means 12.

The time-base generator 73 produces a series of pulses such that said pulses divide each half-cycle timewise into increments equal in number to the number of possible lighting level increments, in the case of the preferred embodiment 200 increments. By distributing the said pulses throughout the half-cycle such that each pulse occurs at a unique predetermined phase angle and by triggering the thyristor regulator means 16 in approximate time coincidence with one of said pulses it will be seen that the intensity of the light output will be dependent upon the unique pulse chosen to trigger the thyristor 39 and the exact phase angle of that pulse. By making selection of one of the 200 pulses in each half-cycle dependent on the above mentioned binary intensity indicating signal, the intensity indicating signal may directly control the intensity of the light. The exact spacing and phase angle of each pulse within the half-cycle will determine the transfer characteristic and the "lighting curve" of the system. The proper selection of phase angle for each and pulse will also consider the non-linear power transfer characteristic arising from the fact that the supply voltage is a sine wave.

Figure 4:
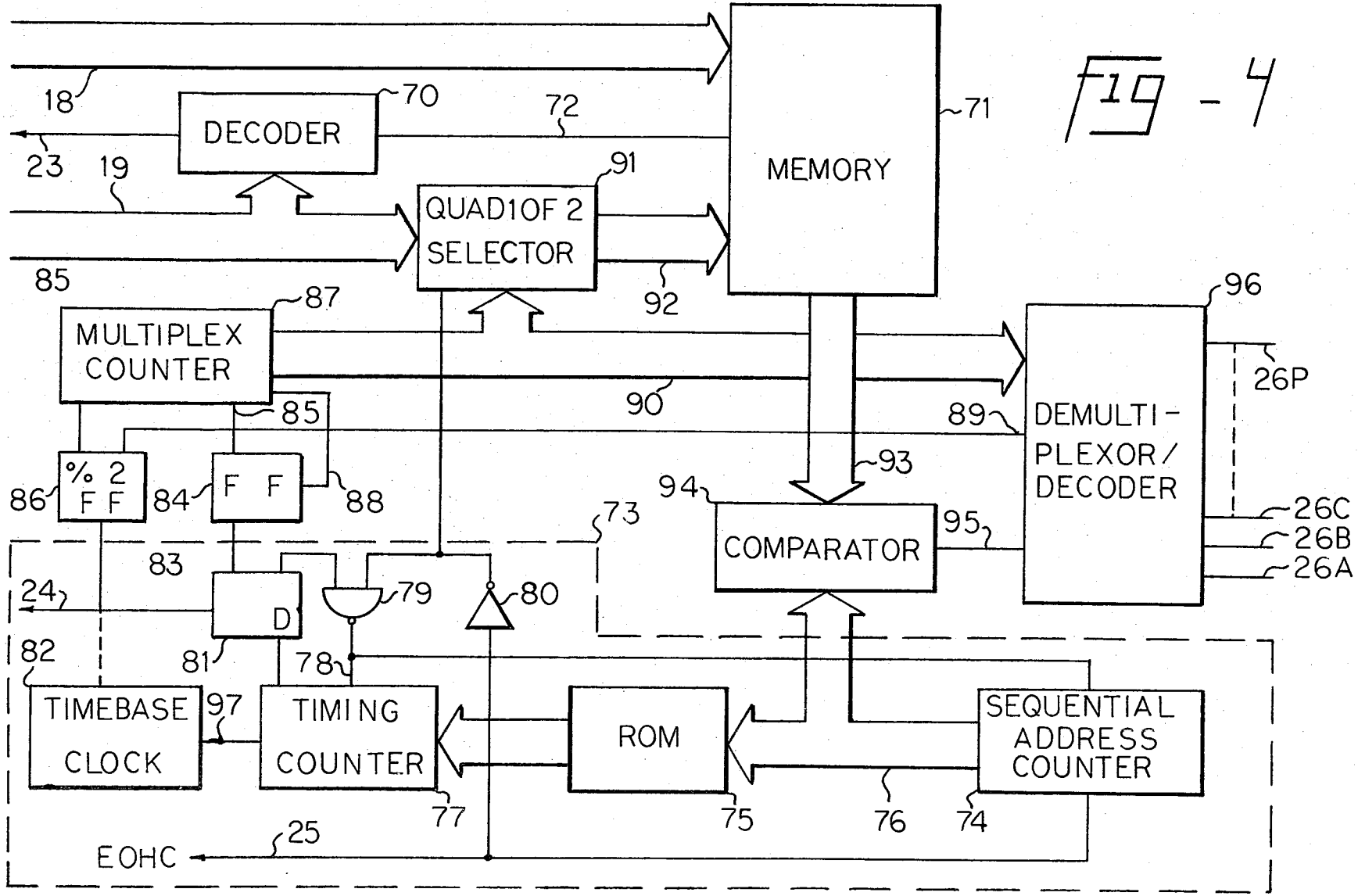
FIG. 4 is a diagram illustrating one embodiment of the trigger generator means according to the invention.

The means for generating said series of pulses is the time-base generator 73, illustrated in FIG. 4, and is essentially comprised of an 8 bit sequential address counter 74, an 8 bit by 200 word read only memory (ROM) 75, and a timing counter 77.

In operation the action of the time-base generator 73 is initiated at the zero crossing of each half-cycle by the EOHC signal. At the end of each half-cycle the EOHC line 25 goes low thus resetting the time-base generator 73. The resetting action involves clearing the address counter 74 to 00000000 and bringing the load input 78 of the timing counter 77 low via action of an inverter 80 and NAND gate 79. This results in the loading of the first word of data from the ROM 75 into the timing counter 77 on the clock pulse immediately following the falling edge of the EOHC signal. At the beginning of each cycle the EOHC line 25 goes high thus enabling the address counter 74 and the timing counter 77 to count. The timing counter 77 counts up in response to clock pulses from the time-base clock 82.

In practice the clock signal applied to the timing counter 77 should have a frequency on the order of 200 KHz, which frequency may be obtained by dividing the 4 MHz system clock signal from the clock line 24 or by employing a second clock generator. The second method is preferable for reasons which will become apparent later. When the timing counter 77 reaches the upper limit of its count (i.e.—11111111) it generates an overflow signal, this signal is delivered to the D input of the D flip-flop 81 and sets the D flip-flop 81 on the following clock pulse.

The output signal the D flip-flop 81 is also delivered to the NAND gate 79 and thence to the load input of the timing counter 77 and the clock input of the sequential address counter 74. Said signal causes the sequential address counter 74 to increment to the next address value, thus causing a new binary signal to be read out of the ROM 75 and loaded into the timing counter 77. As soon as the new value is loaded into the timing counter 77 the overflow signal is no longer delivered to the D flip-flop 81, thus the output of the D flip-flop 81 will go low and hence the load input of the timing counter 77 will return to a high level and counting will resume.

Thus after each binary signal stored in the ROM 75 is counted up by the timing counter 77 an output pulse is generated at the output of the D flip-flop 81 and a new value is loaded into the timing counter 77 and counted up. This process is repeated for each of the 200 memory locations before the EOHC signal resets and reloads counters 74 and 77 at the end of the half cycle. It will be seen that the number of clock pulses between each overflow signal will be equal to the difference between the value delivered from the ROM 75 and the timing counter 77 limit (11111111) plus 1 for the reload pulse. Thus by judicious choice of the values recorded in the ROM the overflow signal and hence the output of the D flip-flop on the timing pulse output line 83 will be comprised of a series of timing pulses meeting the general characteristics of the time-base signal described above.

The first preferred embodiment is illustrated in FIG. 4. In this embodiment, the pulse output 83 of the flip-flop 81 is connected to the input of a second flip-flop 84. The output of said second flip-flop 84 is connected to the enable input 85 of a four bit multiplex counter 87. The multiplex counter 87 receives clock pulses from a divide by two flip-flop 86 connected to the 4 MHz system clock line 24. The four parallel output lines of the multiplex counter 87 are connected to one set of inputs of a data selector gate 91. The other set of inputs to said selector gate 91 being connected to four lines of the address bus 19. The four parallel output lines of the data selector gate 91 are connected to the address input terminals 92 of an 8 bit by 16 word memory device 71, preferably of the bi-polar type.

The 8 data input lines to the memory 71 are connected to the eight lines of the data bus 18. The 8 parallel data output lines of said memory 93 are connected to one set of two sets of inputs of a 8 bit comparator 94, said comparator 94 may be comprised of 8 EXOR gates or a MSI comparator block. The remaining set of input terminals to the comparator 94 are connected to the 8 output lines 76 of the time base generator address counter 74. The output of the comparator 94 is connected to the data or enable input 95 of a 4 to 16 line demultiplexer/decoder 96, the four address input lines of said demultiplexor/decoder being connected to the four output lines of the multiplex counter 90. Each of the 16 output lines 26 A to 26 P of the decoder is connected to a separate thyristor section 16 and delivers a trigger pulse to said thyristor section 16.

Thus, this first embodiment of the trigger pulse generator 12 controls 16 separate channels. The method by which this is accomplished is as follows:

At the end of each cycle the intensity indicating signal appertaining to each of said 16 channels is recorded in a separate memory location. The EOHC line 25 goes low at the end of the half-cycle and causes the selector gate 91 to switch the four least significant address bus lines 19 A to 19 D onto the memory address lines 92 thus the address input to the memory follows the signal levels placed on the address lines 19 A to D by action of the DMA counter 13 previously described. A decoding gate 70 decodes signals on the remaining address bus lines 19 E–P and the write enable line 23 from the DMA 13. Upon receipt of the combination of said signals appertaining to the instant trigger pulse generator 12 the decoder output 72 goes to a low state and delivers a write enable to the memory 71. It will be seen that this action in combination with the action of the DMA 13 described earlier will result in the intensity indicating signal for each channel being recorded in a separate location in the trigger pulse generator memory means 71 at the end of each half-cycle.

At the beginning of each half-cycle the EOHC line 25 goes high causing the selector gate 91 to place the multiplex counter output 90 signals on the memory address lines 92. Simultaneously the time base generator begins its operation as described earlier. Upon reaching a full count the timing counter 77 appertaining to the instant trigger pulse generator sets the first flip-flop 81. The second flip-flop 88 is then set thus enabling the multiplex counter 87. The multiplex counter 87 counts up from 0000 to 1111 in response to clock pulses from the divide by two (toggle) flip-flop 86. Upon reaching a full count (1111) it generates an overflow signal 88 which resets the second flip-flop 84 and disables further counting by the multiplex counter 87 until such time as another timing pulse is received. As the multiplex counter 87 counts through its counting sequence it causes the contents of each location in the memory 71 to be delivered to the comparator means 94 and compared to the value on the time-base generator address counter output 76, which value remains constant throughout each iteration of the multiplex counter 87. It will be seen that over the course of each half-cycle each of the 16 intensity indicating signal values in the memory 71 will be compared to each of the 200 address values generated by the time-base generator address counter 74. Furthermore, because the address counter 74 is incremented by timing pulses from the timing counter 78 it can be considered in effect to be accumulating said pulses; hence, providing a sequential numbering of intensity increments. It will also facilitate understanding to point out that the preferred memory device 71 inherently inverts the sense of the data producing an output equal equal to the one's compliment of the input. The value from memory 71 will thus be equal to the value from the address counter 74 at a time in relation to the half-cycle which is the time appropriate for the generation of a trigger pulse. Thus the output 95 of the comparator 94 when demultiplexed onto one of the 16 trigger pulse output lines will provide a trigger pulse output of the desired phase angle. For example, an intensity indicating signal of 11111110 will be inverted by the memory 71 thus producing a signal value of 00000001 at the input of the comparator 94 for each pulse of the time-base generator pulse train. This value will generate a trigger pulse output from the comparator 94 only when the sequential address counter output 76 holds a value equal to 00000001 which, of course, will be true only at the beginning of the half-cycle; that is, immediately after the first timing pulse delivered from the flip-flop 81. Said trigger pulse will appear on one of the demultiplex output lines 26, and will trigger a thyristor section 16 thus delivering full intensity to a lamp 41 in response to an intensity indicating signal indicating full intensity.

Conversly an intensity indicating signal of 00111000, indicating a low intensity, when inverted by the memory 71 will be 11000111 and will not produce an output from the comparator until the time-base generator address counter 74 has counted to said value, which will not occur until very late in the half-cycle; hence the trigger pulse will be delivered to the thyristor section 16 very late in the half-cycle and the lamp 41 will produce a low intensity.

It happens that in the circuit described above the time delay inherent in the memory 71 may cause an intensity indicating signal intended for one channel to be read out during the multiplex time period for an adjacent (time-wise) channel. This difficulty is overcome by use of the divide by 2 flip-flop 86 which alternately delivers a clock pulse to increment the multiplex counter 87 and a pulse which is delivered to an enable input 89 of the demultiplexor decoder 96. Thus the demultiplexor 96 is enabled only after the memory output 93 and comparator output 95 have settled out.

In the second method of preferred embodiment the intensity indicating signals are recorded in a presettable up counter 99 for each channel and counted up in response to the time-base pulses until an overflow signal is produced. This overflow signal is the trigger pulse.

In this embodiment a counter means 99 is provided for each channel. The recording of the intensity indicating signal is accomplished at the end of each half-cycle by an address decoder 70 which produces an enable signal in response to a unique address signal on the address bus 19 and a write enable signal 23 from the DMA 13. The enable signal produced by the decoder is delivered to the counter 99 over an enable line 72 and causes the counter 99 to latch the data placed on the data bus 18 by action of the DMA 13. For each half-cycle a series of time-base pulses are generated by the timebase generator 73, placed on the time-base line 83 and delivered to the counter 99 input causing it to count up until it reaches an overflow. It will be seen that when the intensity indicating value is high—say 11111110, few time-base pulses will be required to generate an overflow/trigger pulse thus said trigger pulse will be delivered to the thyristor section 16 early in the half-cycle and the light intensity will be high. Conversely, when the intensity indicating signal is of a low value—say 0011 1000, many more time-base pulses will be required to produce an overflow and the trigger pulse will be generated late in the half-cycle; hence, light intensity will be low.

The main advantage of this second embodiment lies in its simplicity.

It will be seen that the first preferred embodiment of the trigger pulse generator may produce trigger pulses of a duration too short to trigger a thyristor; this difficulty is overcome by the thyristor section 16 illustrated in FIG. 1. The trigger pulse signal sets the flip-flop 27 comprised of two NAND gates 28 and 29, this flip-flop 27 is reset at the end of each half-cycle by the EOHC line 25. The flip-flop output terminal 30 goes low when the flip-flop receives a trigger pulse from the trigger pulse line 26 and remains low until the end of the half cycle thus causing current to flow in the light emitting diode 31 for a time beginning immediately after the receipt of a trigger pulse. The current through said diode 31 is supplied from a positive DC voltage supply 33 and limited by a resistance 32. The light emitting diode 31 is optically coupled to a photo-transistor 34. When the diode 31 is illuminated the transistor 34 conducts a current from the 15 volt supply terminals 35 through the resistor 36 and causes a voltage to appear across the resistor 36 and hence across the parallel connected gate control input 37 of the thyristor 39. This action results in the thyristor 39 being turned on at approximately the same time that a pulse is delivered to the flip-flop from the trigger pulse generator and thus allowing current to flow through the Lamp 41 connected in series with the AC line supply terminals 40 and 42.

It will further be seen that the digital time base generator of the present invention provides a convenient and economical method of compensation for fluctuations in the average line voltage. It is often desirable to include in lighting systems for theaters and television studios and the like a means for regulating the light output with respect to the supply line voltage such that the light output will remain essentially constant despite moderate changes in the supply line voltage. This regulation is generally accomplished by generating and delivering to the thyristor a trigger pulse earlier in the half-cycle for lower line voltages than would be the case for a normal line voltage. In the present invention this is accomplished by producing a DC voltage proportional over a certain range to the difference between the maximum line voltage and the actual line voltage and using this DC voltage to control the frequency of a voltage controlled oscillator (VCO) 107, which produces the clock frequency for the timebase generator 73. The frequency of the clock pulses is inversely proportional to the line voltage over a certain range, thus the time base pulses and consequently the trigger pulses will be generated earlier in the half cycle for a low line voltage than would be the case for a full line voltage. Thus the power is delivered to the load for a greater length of time to compensate for the reduced line voltage and the light intensity will remain essentially constant.

Figure 6:
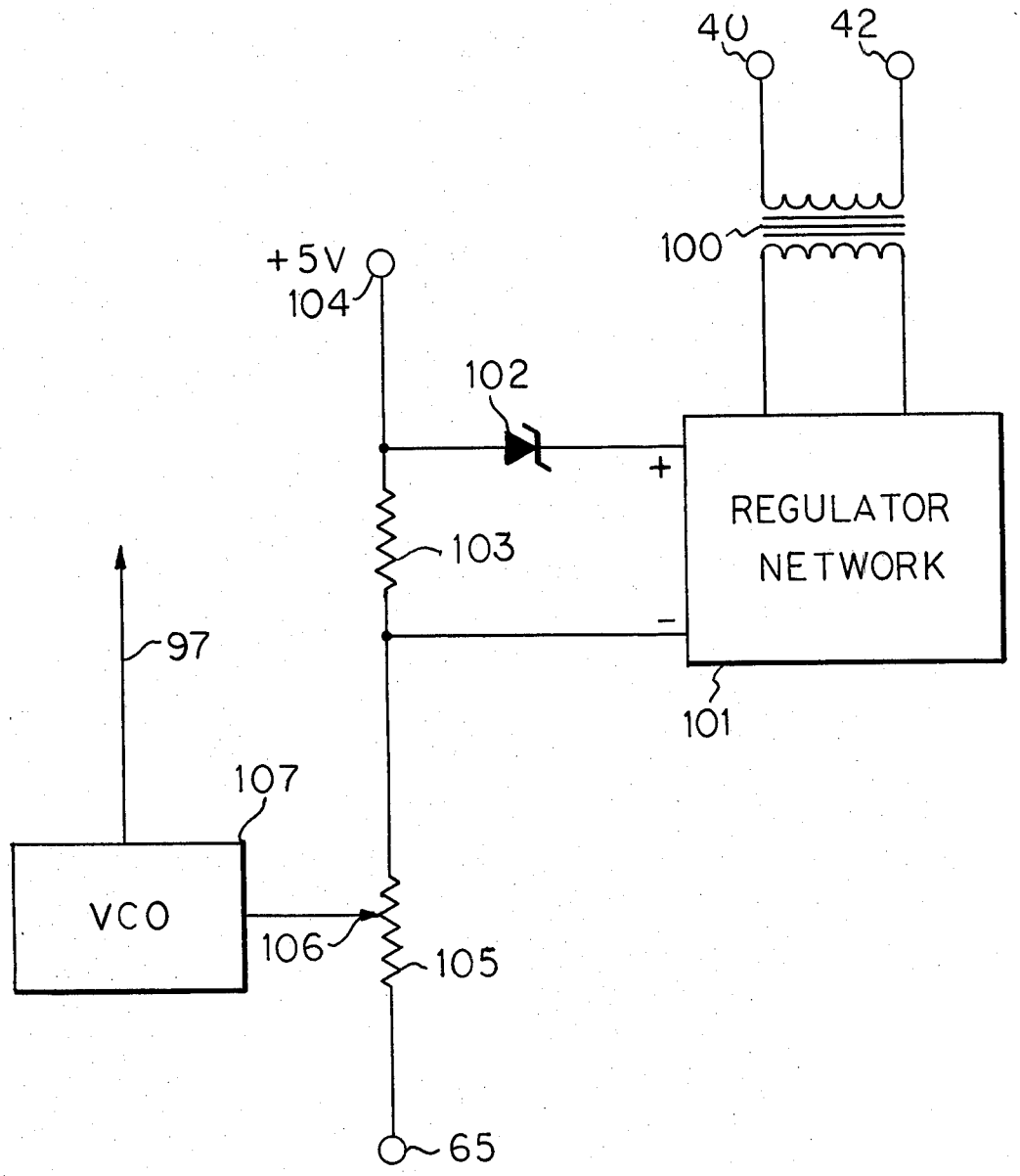
FIG. 6 is a diagram illustrating a voltage regulating means.

The regulator consists of a clock means 82 as illustrated in FIG. 6, essentially comprised of a regulating network 101 and a voltage controlled oscillator 107 (VCO).

The AC line voltage appearing between the AC line terminals 40 and 42 is applied to a step down transformer. In addition to reducing the line voltage proportionally said transformer serves to isolate the circuit from the AC line.

The output of the transformer is applied to the input terminals of the regulator network 101 which produces a DC voltage output proportional to the input. The regulator network 101 may amount to nothing more than a "power supply" type circuit with an RC filter time constant on the order of two tenths of a second.

The output of the regulator network 101 is connected through a reverse connected Zener diode 102 to a resistor 103 so that the voltage across the resistor will be proportional to the output of the regulator network 101 as long as said voltage is greater than the breakdown voltage of the Zener diode 102. The purpose of this Zener diode 102 is to limit the regulating action to an appropriate range of line voltage, say 90 to 120 AC volts.

The positive terminal of the resistor 103 is connected to a terminal 104 providing a fixed DC reference voltage with respect to the system common return 65. The negative terminal of the resistor is connected through a potentiometer 105 to the system common return 65. Whereas the voltage drop across the resistor 103 and potentiometer 105 combination is held constant by the reference voltage at 104, a change in the voltage across the resistor 103 due to action of the regulator network 101 will result in a voltage change of equal magnitude but of opposite polarity across the potentiometer 105. Thus as the line voltage drops the voltage across the resistor 103 will drop proportionately and the voltage across the potentiometer 105 will increase proportionately. Therefore a voltage will appear at the slider 106 of the potentiometer 105 which is inversely proportional to the AC line voltage appearing at the terminals 40 and 42. Said voltage is applied to the control terminal of a voltage controlled oscillator 107 which generates oscillations the frequency of which is proportional to the said voltage. The said oscillations are applied to the timing counter clock line 97. As the frequency of the Voltage Controlled Oscillators 107 oscillations increase in response to a decrease in the line voltage the timing counter 77 counts faster and generates overflow pulses and hence trigger pulses earlier than would be the case for a higher line voltage. The earlier generation of trigger pulses causes power to be delivered to the load 41 for a longer time during each half cycle and thus compensates for the reduced line voltage.

While the invention has been explained by describing two particular embodiments thereof, it will be apparent to those skilled in the art that modification may be made without departing from the scope of the invention, by, for example, using a Random Access Memory in place of the Read Only Memory or by using Analog to Digital Converters or up/down counters in place of the computer, as known in the art.

What is claimed is:

1. A circuit system for controlling the intensity of a plurality of lights comprising, in combination:

a means for producing a binary coded intensity indicating signal for each channel indicating the desired intensity for said channel, a means for communicating said binary coded intensity indicating signal from said production means to a trigger pulse generator means, one or more trigger pulse generator means disposed to receive said binary coded intensity indicating signal and produce during each half-cycle of the AC line voltage a trigger pulse signal for each channel the phase relation of which pulse signal to the AC line is a function of the said binary coded intensity indicating signal, one or more means for producing a nonlinear binary timebase signal controlling the transfer characteristics of said trigger pulse generating means comprising a timebase clock, a memory means, an address counter and a timing counter connected such that the address counter sequentially addresses the memory means and is incremented by a timing counter overflow and such that the timing counter reads data from the memory and counts the difference between the value of said data and a fixed value at a rate determined by a timebase clock and where the operation of said means is repeated for each half-cycle of the AC line, one or more thyristors connected so as to vary the power available to a lamp connected in series with said thyristor and the AC line in response to the varying of the phase relation to the AC line voltage of the trigger pulse signal applied to said thyristor.

2. Apparatus according to claim 1, wherein the means for producing the binary coded intensity indicating signal for each channel comprises a digital computer, minicomputer or microcomputer.

3. Apparatus according to claim 2, wherein the binary coded intensity indicating signal is stored in a memory means.

4. Apparatus according to claim 1 wherein the means for communicating said binary coded intensity indicating signal is a direct memory access (DMA) means.

5. Apparatus according to claim 1 wherein the trigger pulse generator means is essentially comprised of a latching and counting means which latches said binary coded intensity indicating signal and counts in response to said time base signal.

6. Apparatus according to claim 1 wherein the trigger pulse generator means is essentially comprised of:

a memory means connected so as to periodically receive and record said binary coded intensity indicating signal or signals, a binary comparator means connected so as to compare said binary coded intensity indicating signal or signals to the accumulated binary time-base signal and produce an output when the two are of equal value.

7. Apparatus according to claim 6 further comprised of a multiplexing and demultiplexing means connected so as to sequentially compare each of a plurality of intensity indicating signals to each value of said time base signal.

8. Apparatus according to claim 1 wherein said memory means contained in said means for producing a nonlinear binary timebase signal is a programmable read only memory (PROM).

9. Apparatus according to claim 1 further comprised of a binary counting means connected so as to accumulate said nonlinear binary timebase signal pulses during each half cycle of the AC line voltage to produce a consecutive series of binary values each of which corresponds to a certain lighting level increment.

10. Apparatus according to claim 1 further comprised of a voltage regulator means wherein said voltage regulator means utilizes a voltage controlled oscillator to supply timing clock pulses to said time base generator.

* * * * *